US008133843B2

(12) United States Patent
Oguma et al.

(10) Patent No.: US 8,133,843 B2
(45) Date of Patent: Mar. 13, 2012

(54) HEAT-SENSITIVE TRANSFER IMAGE-RECEIVING SHEET

(75) Inventors: Kazuaki Oguma, Minami-ashigara (JP); Shigeru Shibayama, Minami-ashigara (JP)

(73) Assignee: Fujifilm Corporation, Tokyo (JP)

( * ) Notice: Subject to any disclaimer, the term of this patent is extended or adjusted under 35 U.S.C. 154(b) by 650 days.

(21) Appl. No.: 12/360,481

(22) Filed: Jan. 27, 2009

(65) Prior Publication Data

US 2009/0191365 A1 Jul. 30, 2009

(30) Foreign Application Priority Data

Jan. 30, 2008 (JP) ..... 2008-019858

(51) Int. Cl.
*B41M 5/40* (2006.01)

(52) U.S. Cl. ..... 503/227; 428/32.39; 8/471

(58) Field of Classification Search ..... 503/227; 428/32.39, 32.5; 8/471
See application file for complete search history.

(56) References Cited

U.S. PATENT DOCUMENTS

| | | | | |
|---|---|---|---|---|
| 7,799,736 | B2 * | 9/2010 | Irita et al. | 503/227 |
| 7,960,309 | B2 * | 6/2011 | Irita et al. | 503/227 |
| 7,968,496 | B2 * | 6/2011 | Irita et al. | 503/227 |
| 2007/0202277 | A1 * | 8/2007 | Arai et al. | 428/32.6 |
| 2007/0213219 | A1 * | 9/2007 | Irita et al. | 503/227 |
| 2007/0213220 | A1 * | 9/2007 | Irita et al. | 503/227 |
| 2008/0081134 | A1 * | 4/2008 | Irita et al. | 428/32.76 |

FOREIGN PATENT DOCUMENTS

| | | | |
|---|---|---|---|
| JP | 05-008572 | A | 1/1993 |
| JP | 3226167 | B2 | 8/2002 |
| JP | 2006-088691 | A | 4/2006 |
| JP | 2007-229987 | A | 9/2007 |
| JP | 2007-237643 | A | 9/2007 |

* cited by examiner

*Primary Examiner* — Gerard Higgins
(74) *Attorney, Agent, or Firm* — Sughrue Mion, PLLC

(57) ABSTRACT

A heat-sensitive transfer image-receiving sheet, comprising a support, and at least one heat insulation layer containing hollow polymer particles and at least one receptor layer provided for the support in this order, wherein the receptor layer contains a latex polymer having a glass transition temperature (Tg) of lower than 50° C. and a latex polymer having a glass transition temperature (Tg) of 50° C. or higher, the latex polymer having a glass transition temperature (Tg) of lower than 50° C. is contained in an amount, as solid content, larger than that of the latex polymer having a glass transition temperature (Tg) of 50° C. or higher, and the latex polymer having a glass transition temperature (Tg) of lower than 50° C. is a latex polymer having the recurring unit obtained from vinyl chloride monomer in an amount of 50 mol % or more.

4 Claims, No Drawings

HEAT-SENSITIVE TRANSFER IMAGE-RECEIVING SHEET

FIELD OF THE INVENTION

The present invention relates to a heat-sensitive transfer image-receiving sheet. In particular, the present invention relates to a heat-sensitive transfer image-receiving sheet which prevents cracking during drying after coating and produces no image defects such as white spots in low density region.

BACKGROUND OF THE INVENTION

Various heat transfer recording methods have been known so far. Among these methods, dye diffusion transfer recording systems attract attention as a process that can produce a color hard copy having an image quality closest to that of silver halide photography. Moreover, this system has advantages over silver halide photography: it is a dry system, it enables direct visualization from digital data, it makes reproduction simple, and the like.

In this dye diffusion transfer recording system, a heat-sensitive transfer sheet containing dyes is superposed on a heat-sensitive transfer image-receiving sheet (hereinafter also referred to as an image-receiving sheet), and then the heat-sensitive transfer sheet is heated by a thermal head whose exothermic action is controlled by electric signals, in order to transfer the dyes contained in the heat-sensitive transfer sheet to the image-receiving sheet, thereby recording an image information. Three colors: cyan, magenta, and yellow, or four colors which consists of the three colors and black, are used for recording a color image by overlapping one color to other, thereby enabling transferring and recording a color image having continuous gradation for color densities.

In a recording system such a dye diffusion transfer process, it has been known that it is important to impart high heat insulating property to the heat-sensitive transfer image-receiving sheet in order to obtain favorable images.

Thus, for imparting heat insulating property to the heat-sensitive transfer image-receiving sheet, used is a composite support having a microvoid-containing biaxially oriented polyolefin film as a support for the heat-sensitive transfer image-receiving sheet. However, by this method, because of relaxation of the residual stress at the time of stretching by the heat during printing or coating of a receptor layer, the heat-sensitive transfer image-receiving sheet shrinks, causing crinkling and curling.

Aside from this, proposed was installation of a heat insulation layer containing hollow polymer particles for imparting heat insulating property to the heat-sensitive transfer image-receiving sheet (see, e.g., Japanese Patents No. 2541796 and No. 3226167, JP-A-5-8572 ("JP-A" means unexamined published Japanese patent application) and JP-A-2006-88691). However, such a method is not necessarily satisfactory because the following problems have emerged: it is difficult to obtain a uniform and smooth heat-sensitive transfer image-receiving sheet, there arise improper transfer of images, white spots, surface irregularity and protective-layer adhesion failure, the production process is complicated and disadvantageous from the viewpoint of productivity. Further, such a method brings in a new problem that the glossiness of a solid black image deteriorates.

Alternatively proposed is a method of using two or more kinds of latex polymers for the receptor layer (see, for example, JP-A-2007-237643 and JP-A-2007-229987). However, these methods do not necessarily give images having satisfactory properties, for example, in the case where the manufacturing condition or the drying condition is modified in order to improve the productivity of the heat-sensitive transfer image-receiving sheet.

In addition, heat-sensitive transfer image-receiving sheets prepared by aqueous coating often showed, under various environmental conditions (in particular, humidity conditions), difference in properties larger than that of the heat-sensitive transfer image-receiving sheets prepared by organic solvent-based coating. Thus, there has been a demand for reduction of the environmental dependency of the sheets during printing.

Therefore, there exists a need for a method giving images stabilized in properties, even after such modification.

SUMMARY OF THE INVENTION

The present invention resides in a heat-sensitive transfer image-receiving sheet, comprising a support, and at least one heat insulation layer containing hollow polymer particles and at least one receptor layer provided for the support in this order, wherein the receptor layer comprises a latex polymer having a glass transition temperature (Tg) of lower than 50° C. and a latex polymer having a glass transition temperature (Tg) of 50° C. or higher, wherein the latex polymer having a glass transition temperature (Tg) of lower than 50° C. is contained in an amount, as solid content, larger than an amount of the latex polymer having a glass transition temperature (Tg) of 50° C. or higher, and wherein the latex polymer having a glass transition temperature (Tg) of lower than 50° C. is a latex polymer having a recurring unit obtained from vinyl chloride monomer in an amount of 50 mol % or more.

Other and further features and advantages of the invention will appear more fully from the following description.

DETAILED DESCRIPTION OF THE INVENTION

According to the present invention, there is provided the following means:

(1) A heat-sensitive transfer image-receiving sheet, comprising a support, and at least one heat insulation layer containing hollow polymer particles and at least one receptor layer provided for the support in this order, wherein the receptor layer comprises a latex polymer having a glass transition temperature (Tg) of lower than 50° C. and a latex polymer having a glass transition temperature (Tg) of 50° C. or higher, wherein the latex polymer having a glass transition temperature (Tg) of lower than 50° C. is contained in an amount, as solid content, larger than an amount of the latex polymer having a glass transition temperature (Tg) of 50° C. or higher, and wherein the latex polymer having a glass transition temperature (Tg) of lower than 50° C. is a latex polymer having a recurring unit obtained from vinyl chloride monomer in an amount of 50 mol % or more.

(2) The heat-sensitive transfer image-receiving sheet described in the above item (1), wherein the receptor layer further comprises at least one kind of polymer compound having fluorine atom-substituted aliphatic groups on its side chains.

(3) The heat-sensitive transfer image-receiving sheet described in the above item (1) or (2), wherein the latex polymer having a glass transition temperature (Tg) of 50° C.

or higher is a latex polymer having a recurring unit obtained from vinyl chloride monomer in an amount of 92 mol % or more.

Hereinafter, the heat-sensitive transfer image-receiving sheet according to the present invention will be described in detail.

The heat-sensitive transfer image-receiving sheet according to the present invention comprises a support, and at least one heat insulation layer containing hollow polymer particles and at least one receptor layer provided for the support in this order, wherein the receptor layer comprises a latex polymer having a glass transition temperature (Tg) of lower than 50° C. and a latex polymer having a glass transition temperature (Tg) of 50° C. or higher, the latex polymer having a glass transition temperature (Tg) of lower than 50° C. is contained in an amount, as solid content, more than an amount of the latex polymer having a glass transition temperature (Tg) of 50° C. or higher, and the latex polymer having a glass transition temperature (Tg) of lower than 50° C. is a latex polymer having the recurring unit obtained from vinyl chloride monomer in an amount of 50 mol % or more.

When the latex polymer having a glass transition temperature (Tg) lower than 50° C. is contained as solid content more than the latex polymer having a glass transition temperature (Tg) of 50° C. or higher, particularly in the case where the heat-sensitive transfer image-receiving sheet is prepared by high-speed coating, it is possible to prevent significantly cracking of the heat-sensitive transfer image-receiving sheet obtained.

The solid content mass ratio of the latex polymer having a glass transition temperature (Tg) lower than 50° C. to the latex polymer having a glass transition temperature (Tg) of 50° C. or higher is preferably 1.05 or more, more preferably 1.1 or more, still more preferably 1.2 or more, and most preferably 1.3 or more. The upper limit of the solid content is preferably 50.

The latex polymer added to the receptor layer is used for receiving dye, and the receptor layer may contain additives such as water-soluble polymers, ultraviolet absorbents, releasing agents, lubricants, antioxidants, antiseptics, surfactants and others. The heat-sensitive (thermal) transfer image-receiving sheet that can be used in the present invention is provided with at least one heat insulation layer (porous layer) between the support and the receptor layer. Moreover, an intermediate layer such as a gloss control layer, a white background adjusting layer, a charge control layer, an adhesive layer, and a primer layer, may be provided with the receptor layer.

The receptor layer, the heat insulation layer and other intermediate layers are preferably formed by simultaneous multilayer coating, and a multiple number of these layers may be formed as needed. When multiple receptor layers are formed, the layer most separated from the support preferably comprises the two kinds of latex polymers described above.

In addition, to maximize the insulation effect of the heat insulation layer, the receptor layer and the heat insulation layer are preferably in contact with each other without installation of an additional interlayer between the receptor layer and the heat insulation layer.

A curling control layer, a writing layer, or a charge-control layer may be formed on the backside of the support. Each of these layers may be applied using a usual method such as a roll coating, a bar coating, a gravure coating, and a gravure reverse coating.

The latex polymer is generally a dispersion of fine particles of thermoplastic resin in a water-soluble dispersion medium. Examples of the thermoplastic resins used for the latex polymer according to the present invention include polycarbonates, polyesters, polyacrylates, vinyl chloride copolymers, polyurethane, styrene-acrylonitrile copolymers, polycaprolactone and the like.

Among them, polycarbonates, polyesters, and vinyl chloride copolymers are preferable, polyesters and vinyl chloride copolymer are particularly preferable, and vinyl chloride copolymer is most preferable.

The polyester is prepared by condensation of a dicarboxylic acid derivative and a diol compound, and may include an aromatic ring and/or a saturated carbon ring as well as a water-soluble group for imparting dispersibility thereto.

The vinyl chloride copolymer is a copolymer prepared with vinyl chloride as the polymerization monomer and other monomers, and examples thereof include vinyl chloride-vinyl acetate copolymers, vinyl chloride-acrylate copolymers, vinyl chloride-methacrylate copolymers, vinyl chloride-vinyl acetate-acrylate copolymers, and vinyl chloride-acrylate-ethylene copolymers. As described above, the copolymer may be a binary copolymer or a ternary or higher copolymer, and the monomers may be distributed randomly or uniformly by block copolymerization.

The copolymer may contain a unit derived from an auxiliary monomer component such as vinylalcohol derivatives, maleic acid derivatives, and vinyl ether derivatives. The copolymer preferably contain the vinyl chloride component in an amount of 50 mass % or more, and the unit derived from an auxiliary monomer component such as maleic acid derivative and vinyl ether derivative in an amount of 10 mass % or less.

The latex polymers may be used alone or as a mixture. The latex polymer may have a uniform structure or a core/shell structure, and in the latter case, the resins constituting the core and shell respectively may have different glass transition temperatures.

Examples of commercially available latex polymers having a glass transition temperature (Tg) lower than 50° include the followings: acrylate latexes such as Nipol LX814 (Tg: 25° C.) and Nipol LX852X2 (Tg: 43° C.) (trade names, manufactured by Zeon Corporation); polyester latexes such as VYLONAL MD-1100 (Tg: 40° C.), VYLONAL MD-1400 (Tg: 20° C.), VYLONAL MD-1480 (Tg: 20° C.), and VYLONAL MD-1985 (Tg: 20° C.), (trade names, manufactured by Toyobo Co. Ltd.), PLAS COAT Z-850 (Tg: 20° C.) (trade name, manufactured by Goo Chemical Co., Ltd.), and Elitel KZA134 (Tg: 40° C.) (trade name, manufactured by Unitika Ltd.); vinyl chloride latex copolymers such as VINYBLAN 276 (Tg: 33° C.), VINYBLAN 609 (Tg: 46° C.) (trade names, manufactured by Nisshin Chemical Industry Co., Ltd.), Sumielite 1320 (Tg: 40° C.) and Sumielite 1210 (Tg: 30° C.) (trade names, manufactured by Sumika Chemtex Company, Limited).

Examples of commercially available latex polymers having a glass transition temperature (Tg) of 50° C. or higher include the followings: polyester latexes such as VYLONAL MD-1200 (Tg: 67° C.), VYLONAL MD-1245 (Tg: 61° C.), and VYLONAL MD-1500 (Tg: 77° C.) (trade names, manufactured by Toyobo Co. Ltd.), PLAS COAT Z-450 (Tg: 55° C.) and PLAS COAT Z-561 (Tg: 64° C.) (trade names, manufactured by Goo Chemical Co., Ltd.), and Elitel KA5034 (Tg: 67° C.) (trade name, manufactured by Unitika Ltd.); and vinyl chloride latex copolymers such as VINYBLAN 900 (Tg: 70° C.) and VINYBLAN 683 (Tg: 72° C.) (trade names, manufactured by Nisshin Chemical Industry Co., Ltd.).

Each of the two kinds of latex polymers for use in the present invention is preferably a vinyl chloride latex copolymer, and each of them is more preferably a latex polymer having the recurring unit obtained from vinyl chloride monomer in an amount of 50 mol % or more.

In the two kinds of latex polymers for use in the present invention, the latex polymer having a glass transition temperature (Tg) lower than 50° C. is a vinyl chloride latex copolymer. The latex polymer having a glass transition temperature (Tg) lower than 50° C. and the latex polymer having a glass transition temperature (Tg) of 50° C. or higher are more preferably both latex polymers having the recurring unit obtained from vinyl chloride monomer in an amount of 50 mol % or more. The amount of the recurring unit obtained from vinyl chloride monomer is more preferably 75 mol % or more both in the two kinds of copolymers. In particular, the amount of the recurring unit obtained from vinyl chloride monomer in the latex polymer having a glass transition temperature (Tg) of 50° C. or higher is most preferably 92 mol % or more.

The addition amount of the latex polymers (latex polymer solid content) is preferably 50 to 98 mass %, more preferably 70 to 95 mass %, with respect to all polymers in the receptor layer. The average particle diameter of the latex polymers is preferably 1 to 50,000 nm, more preferably 5 to 1,000 nm.

The receptor layer may contain, as a releasing agent, ordinary solid waxes such as polyethylene or amide wax, silicone oil, a phosphate ester compound, a fluorine-series surfactant, or a silicone-based surfactant.

The receptor layer preferably contains a polymer compound having fluorine atom-substituted aliphatic groups on the side chains (hereinafter this compound is also referred to as fluorine series oligomer and include an oligomer in this specification), for further improvement of the advantageous effects of the present invention. The polymer compound having fluorine atom-substituted aliphatic groups on the side chains contained in the receiving layer will be described below in detail.

The polymer compound having fluorine atom-substituted aliphatic groups on its side chains can be derived from a fluoro aliphatic compound (compound having a fluorine atom-substituted aliphatic group(s) on the side chain(s)) produced by a telomerization method (also referred to as a telomer method), or an oligomerization method (also referred to as an oligomer method). The fluoro aliphatic compound can be easily synthesized by, for example, a method described in JP-A-2002-90991.

The fluorine atom-substituted aliphatic group is an aliphatic group (straight-chain, branched or cyclic aliphatic group), preferably an alkyl, alkenyl or cycloalkynyl group having 1 to 36 carbon atoms, having at least one substituted fluorine atom, more preferably an alkyl group having 1 to 36 carbon atoms (preferably 1 to 18 carbon atoms, more preferably 1 to 12 carbon atoms, furthermore preferably 1 to 10 carbon atoms, most preferably 4 to 8 carbon atoms) having at least one substituted fluorine atom. The aliphatic group may be substituted additionally with a substituent other than the fluorine atom. Examples of the substituent include alkyl groups, aryl groups, heterocyclic groups, halogen atoms other than the fluorine atom, a hydroxyl group, alkoxy groups, aryloxy groups, alkylthio groups, arylthio groups, an amino group, alkylamino groups, arylamino groups, heterocyclic amino groups, acylamino groups, sulfone amino groups, carbamoyl groups, sulfamoyl groups, a cyano group, a nitro group, acyl groups, sulfonyl groups, ureido groups, and urethane groups.

In the present invention, the fluorine atom-substituted aliphatic group is most preferably a perfluoroalkyl group.

The polymer compound having fluorine atom-substituted aliphatic group(s) on the side chains is preferably a polymer or copolymer of a fluorine atom-substituted aliphatic group-containing monomer, and examples of the monomer include acrylic acid derivatives (e.g., acrylic acids, acrylic esters, and acrylamides, preferably acrylic esters and acrylamides, more preferably acrylic esters) and methacrylic acid derivatives (e.g., methacrylic acids, methacrylic esters, and methacrylamides, preferably methacrylic esters and methacrylamides, more preferably methacrylic esters) each having an acyl moiety, alcohol moiety or amide moiety (a substituent bonding with the nitrogen atom) substituted with a fluorine atom-substituted aliphatic group; and acrylonitrile derivatives having a fluorine atom-substituted aliphatic group.

In the case where the polymer compound having fluorine atom-substituted aliphatic groups on the side chains is a copolymer with a fluorine atom-substituted aliphatic group-containing monomer, examples of the monomer used in combination include acrylates, methacrylates, acrylonitriles, acrylamides, methacrylamides, olefins, and styrenes. Among these, acrylates, methacrylates, acrylonitriles, acrylamides, and methacrylamides are preferable; acrylates and methacrylates are more preferable; and among them, those having a polyoxyalkylene (e.g., polyoxyethylene, polyoxypropylene) unit in the group substituted on the alcohol group or the amide nitrogen atom are preferable.

In the present invention, the polymer above is preferably a copolymer, which may be a binary copolymer or a ternary or higher copolymer.

As the polymers having a fluoro aliphatic group on its side chains, preferred are copolymers of a monomer having an aliphatic group substituted with a fluorine atom and poly(oxyalkylene)acrylate and/or poly(oxyalkylene)methacrylate. They may be random copolymers or block copolymers. Examples of the poly(oxyalkylene) group include poly(oxyethylene) group, poly(oxypropylene) group, and poly(oxybutylene) group. Further, the poly(oxyalkylene) group may be a unit having alkylene groups of chain lengths different from each other in the same chain, such as poly(block connector of oxyethylene and oxypropylene and oxyethylene) and poly(block connector of oxyethylene and oxypropylene). Further, the copolymer of a monomer having an aliphatic group substituted with a fluorine atom and poly(oxyalkylene)acrylate (or methacrylate) is not limited to binary copolymers, but may be ternary or more multiple copolymers that can be produced by copolymerizing several different co-monomers such as monomers having two or more different aliphatic groups substituted with a fluorine atom and two or more different kinds of poly(oxyalkylene)acrylate (or methacrylate).

A weight-average molecular weight of the polymers having an aliphatic group substituted with a fluorine atom on its side chains ranges preferably from 5,000 to 50,000, more preferably from 8,000 to 30,000, and further preferably from 10,000 to 20,000.

Examples of the copolymers include copolymers of acrylate (or methacrylate) having a perfluorobutyl group ($—C_4F_9$) and poly(oxyalkylene)acrylate (or methacrylate); copolymers of acrylate (or methacrylate) having a perfluorobutyl group, poly(oxyethylene)acrylate (or methacrylate) and poly(oxypropylene)acrylate (or methacrylate); copolymers of acrylate (or methacrylate) having a perfluorohexyl group ($—C_6F_{13}$) and poly(oxyalkylene)acrylate (or methacrylate); copolymers of acrylate (or methacrylate) having a perfluorohexyl group, poly(oxyethylene)acrylate (or methacrylate) and poly(oxypropylene)acrylate (or methacrylate); copolymers of acrylate (or methacrylate) having a perfluorooctyl group ($—C_8F_{17}$) and poly(oxyalkylene)acrylate (or methacrylate); and copolymers of acrylate (or methacrylate) having a perfluorooctyl group, poly(oxyethylene)acrylate (or methacrylate) and poly(oxypropylene)acrylate (or methacrylate).

Further, the polymers having an aliphatic group substituted with a fluorine atom at a side chain are commercially available as a general name such as "perfluoroalkyl-containing oligomers". For example, the following products can be used.

As the products of Dainippon Ink & Chemicals Incorporated, there are Megafac F-470, Megafac F-471, Megafac F-472SF, Megafac F-474, Megafac F-475, Megafac F-477, Megafac F-478, Megafac F-479, Megafac F-480SF, Megafac F-472, Megafac F-483, Megafac F-484, Megafac F-486, Megafac F-487, Megafac F-489, Megafac F-172D, Megafac F-178K, Megafac F-178RM (each product name). As the products of Sumitomo 3 M Limited, there are Novec™ FC-4430 and FC-4432 (each trade name).

The polymer compound having aliphatic groups substituted with a fluorine atom on its side chains is preferably a nonionic compound (having no dissociable group in water such as sulfo group and carboxyl group), and more preferably water-soluble to a certain degree. The phrase "water soluble to a certain degree" means that the polymer compound has solubility in pure water of 1% or more at 25° C. Specifically, the polymer is, for example, a polymer compound having a hydroxyl group(s) and/or the oxyalkylene group(s) described above. Favorable examples thereof include water-soluble compounds such as Megafac F-470, Megafac F-472SF, Megafac F-477, Megafac F-479, Megafac F-480SF, Megafac F-484, and Megafac F-486 (all trade names, manufactured by Dainippon Ink & Chemicals Incorporated).

The reason why the polymer having an aliphatic group(s) substituted with a fluorine atom on its side chain(s) is preferably nonionic and soluble in water to a certain degree is not yet to be understood, but is likely the followings: A nonionic polymer compound having an aliphatic group(s) substituted with a fluorine atom on its side chain(s) has strong affinity for the dye and the receiving polymer after thermal transfer, and it is also has moderate affinity for the layer of the heat-sensitive transfer image-receiving sheet prepared by using latex because of its water solubility. Therefore, the nonionic polymer compound bleeds out into the interface between the heat-sensitive transfer sheet and the heat-sensitive transfer image-receiving sheet during printing under high-temperature and high-humidity condition, exhibiting its effective releasing action.

The addition amount of the polymer compound having aliphatic groups substituted with a fluorine atom on its side chains is 0.2% to 10%, preferably 0.5% to 8% and more preferably 1% to 5%, with respect to the total solid content (mass) in the receptor layer. Although use of only one kind of polymer compound having aliphatic groups substituted with a fluorine atom on its side chains alone is effective, use of two or more kinds of polymers above is more effective.

In the image-receiving sheet used in the present invention, the heat insulating layer preferably contains hollow polymer particles.

The hollow polymer particles in the present invention are polymer particles having independent pores inside of the particles. The hollow polymer particles are preferably aqueous dispersion containing this hollow latex polymer. Examples of the hollow polymer particles include non-foaming type hollow particles obtained in the following manner: a dispersion medium, such as water, is contained inside of a capsule wall formed of a polystyrene, acrylic resin, or styrene/acrylic resin, and, after a coating liquid is applied and dried, the dispersion medium in the particles is vaporized out of the particles, with the result that the inside of each particle forms a hollow Specific examples of the above include Rohpake 1055, manufactured by Rohm and Haas Co.; Boncoat PP-1000, manufactured by Dainippon Ink and Chemicals, Incorporated; SX866(B), manufactured by JSR Corporation; and Nippol MH5055, manufactured by Nippon Zeon (all of these product names are trade names). These hollow polymer particles may be used as a mixture of two or more if necessary. The hollow polymer particle is preferably used as a hollow latex polymer.

The average particle diameter (particle size) of the hollow polymer particles is preferably 0.1 to 5.0 μm, more preferably 0.2 to 3.0 μm, and particularly preferably 0.4 to 2.0 μm. The hollow ratio (percentage of void) of the hollow polymer particles is preferably in the range of from 20% to 70%, and particularly preferably from 30% to 65%.

In the present invention, the particle size of the hollow polymer particle is calculated after measurement of the circle-equivalent diameter of the periphery of particle under a transmission electron microscope. The average particle diameter is determined by measuring the circle-equivalent diameter of the periphery of at least 300 hollow polymer particles observed under the transmission electron microscope and obtaining the average thereof. The hollow ratio of the hollow polymer particles is calculated by the ratio of the volume of voids to the volume of a particle.

The heat insulation layer containing hollow polymer particles may contain a latex polymer as a binder in addition to the hollow polymer particles. A latex polymer similar to that described in the section of the receptor layer is used preferably in the present invention which demands aqueous coating. These latexes may be used alone or in combination of two or more. The thickness of the heat insulation layer containing the hollow polymer particles is preferably from 5 to 50 μm, and more preferably from 5 to 40 μm.

In the present invention, it is preferred that the heat insulation layer containing hollow polymer particles contains hollow polymer particles with a solid content of 50% by mass or more after drying, with more preferable solid content of 60% by mass or more. The upper limit of the solid content is preferably 95% by mass or less.

In the heat-sensitive transfer image-receiving sheet of the present invention, it is one of preferred embodiments of the present invention that the receptor layer and/or heat insulation layer contains a water-soluble polymer. Herein, "water-soluble polymer" means a polymer which dissolves, in 100 g water at 20° C., in an amount of preferably 0.05 g or more, more preferably 0.1 g or more, and still more preferably 0.5 g or more.

Specific examples of the water-soluble polymers which can be used in the heat-sensitive transfer image-receiving sheet of the present invention, include carrageenans, pectins, dextrins, gelatins, caseins, carboxymethylcelluloses, hydroxyethylcelluloses, hydroxypropylcelluloses, polyvinyl pyrrolidone, polyvinyl pyrrolidone copolymers, polyvinyl alcohol, polyethylene glycol, polypropylene glycol, and water-soluble polyesters. Among these, gelatin and polyvinyl alcohol are preferable.

Gelatin having a molecular weight of 10,000 to 1,000,000 may be used in the present invention. Gelatin that can be used in the present invention may contain an anion such as $Cl^-$ and $SO_4^{2-}$, or alternatively a cation such as $Fe^{2+}$, $Ca^{2+}$, $Mg^{2+}$, $Sn^{2+}$, and $Zn^{2+}$. Gelatin is preferably added as an aqueous solution.

An ordinary crosslinking agent such as aldehyde-type crosslinking agent, N-methylol-type crosslinking agent, vinylsulfone-type crosslinking agent, or chlorotriazine-type crosslinking agent may be added to the gelatin above. Among the crosslinking agents above, vinylsulfone-type and chlorotriazine-type crosslinking agents are preferable, and typical examples thereof include bisvinylsulfonylmethylether, N,N'-ethylene-bis(vinylsulfonylacetamido)ethane, and 4,6-dichloro-2-hydroxy-1,3,5-triazine or the sodium salt thereof. These crosslinking agents are preferably used in an amount of 0.001 to 1 g, and further preferably 0.005 to 0.5 g, per 1 g (based on solid content) of the water-soluble polymer.

As the polyvinyl alcohol, there can be used various kinds of polyvinyl alcohols such as complete saponification products thereof, partial saponification products thereof, and modified polyvinyl alcohols. With respect to these polyvinyl alcohols, those described in Koichi Nagano, et al., "Poval", Kobunshi Kankokai, Inc. are useful. The viscosity of polyvinyl alcohol can be adjusted or stabilized by adding a trace amount of a solvent or an inorganic salt to an aqueous solution of polyvinyl alcohol, and use may be made of compounds described in the aforementioned reference "Poval", Koichi Nagano et al., published by Kobunshi Kankokai, pp. 144-154. For example, a coated-surface quality can be improved by an addition of boric acid, and the addition of boric acid is preferable. The amount of boric acid to be added is preferably 0.01 to 40 mass %, with respect to the polyvinyl alcohol.

Specific examples of the polyvinyl alcohols include completely saponificated polyvinyl alcohol such as PVA-105, PVA-110, PVA-117 and PVA-117H (trade names, manufactured by KURARAY CO., LTD.); partially saponificated polyvinyl alcohol such as PVA-203, PVA-205, PVA-210 and PVA-220 (trade names, manufactured by KURARAY CO., LTD.); and modified polyvinyl alcohols such as C-118, HL-12E, KL-118 and MP-203 (trade names, manufactured by KURARAY CO., LTD.).

<Subbing Layer>

The heat-sensitive transfer image-receiving sheet according to the present invention preferably has a subbing layer formed between the support and the heat insulation layer. It is possible, by forming the subbing layer, to smoothen surface irregularity of the support and further, by giving cushioning property, to improve the adhesiveness to the heat-sensitive transfer sheet during thermal transfer and prevent white spots during printing and uneven transfer of the protective layer.

The heat-sensitive transfer sheet is explained below.

The heat-sensitive transfer sheet has a support and a thermal transfer layer containing a diffusion transfer dye (hereinafter, referred to as thermal transfer layer or dye layer) formed thereon, and preferably has an additional transfer protective-layer laminate, for forming a protective layer of a transparent resin on the thermally transferred image and thus covering and protecting the image formed on the same support.

In the heat-sensitive transfer sheet, preferably, thermal transfer layers in individual colors of yellow, magenta and cyan, and an optional thermal transfer layer in black are repeatedly provided onto a single support in area order in such a manner that the colors are divided from each other. An example of the thermal transfer layers is an embodiment wherein thermal transfer layers in individual colors of yellow, magenta and cyan are provided onto a single support in the longitudinal direction of the support in area order, correspondingly to the area of the recording surface of the above-mentioned heat-sensitive transfer image-receiving sheet, in such a manner that the colors are divided from each other. In addition to the three layers above, it may have a black thermal transfer layer. In addition, the heat-sensitive transfer sheet preferably has a mark indicating the start point of each of various colors allowing recognition by the printer used.

In the present invention, the thermal transfer layer generally contains a sublimation type dye and a binder. The thermal transfer layer may further contain waxes, silicone resins, polymer particles and inorganic particles, in accordance with necessity.

Each dye in the thermal transfer layers is preferably contained in an amount of 20 to 80 mass %, more preferably in that of 30 to 70 mass % in the thermal transfer layer.

The coating of the thermal transfer layer may be performed by an ordinary method such as roll coating, bar coating, gravure coating, or gravure reverse coating. The coating amount of the thermal transfer layer is preferably from 0.1 to 2.0 g/m$^2$, more preferably from 0.2 to 1.2 g/m$^2$ (the amount is a numerical value converted to the solid content in the layer; any coating amount in the following description is a numerical value converted to the solid content unless otherwise specified). The film thickness of the thermal transfer layer is preferably from 0.1 to 2.0 g/m$^2$, more preferably from 0.2 to 1.2 g/m$^2$.

The dyes are not particularly limited, so far as the dyes are able to diffuse by heat and able to be incorporated in a heat-sensitive transfer sheet, and able to transfer by heat from the heat-sensitive transfer sheet to a heat-sensitive transfer image-receiving sheet. The dyes that have been conventionally used for the heat-sensitive transfer sheet or known dyes can be effectively used.

Each of the thermal transfer layers may have a monolayered structure or a multi-layered structure. In the case of the multi-layered structure, the individual layers constituting the thermal transfer layer may be the same or different in composition.

As the binder, various kinds of binder are known, and these can be used in the present invention. The binder in the present invention is preferably a cellulose resin or a polyvinyl acetal resin, more preferably a polyvinyl acetal resin. In particular, polyvinyl acetoacetal resin or polyvinyl butyral resin is preferably used in the prevent invention. It is also possible to use them alone or as a mixture or a copolymer, and the binder may be crosslinked with any crosslinking agent.

A transferable protective layer laminate is preferably formed in area order onto the heat-sensitive transfer sheet. The transferable protective layer laminate is used to protect a heat-transferred image with a protective layer composed of a transparent resin, thereby to improve durability such as scratch resistance, light-fastness, and resistance to weather. This laminate is effective in the case where the transferred dye is insufficient in image durability such as light resistance, scratch resistance, and chemical resistance in the state that the dye is naked in the surface of an image-receiving sheet.

The transferable protective layer laminate can be formed by forming, onto a support, a releasing layer, a protective layer and an adhesive layer in this order successively. The protective layer may be formed by plural layers. In the case where the protective layer also has functions of other layers, the releasing layer and the adhesive layer can be omitted. It is also possible to use a support on which an easy adhesive layer has already been formed.

As a transferable protective layer-forming resin, preferred are resins that are excellent in scratch resistance, chemical resistance, transparency and hardness. Examples of the resin include polyester resins, acrylic resins, polystyrene resins, polyurethane resins, acrylic urethane resins, silicone-modified resins of the above-described resins, ultraviolet-shielding resins, mixtures of these resins, ionizing radiation-curable resins, and ultraviolet-curing resins. Particularly preferred are polyester resins and acrylic resins. These resins may be crosslinked with various crosslinking agents.

In the heat-sensitive transfer sheet, it is preferred to dispose a back side layer on the surface (back side) of the support opposite to the thermal transfer layer coating side, namely on the same side as the surface with which a thermal head and the like contact. In addition, in the case of the protective layer transfer sheet, it is also preferred to dispose a back side layer on the surface (back side) of the support opposite to the transferable protective layer coating side, namely on the same side as the surface with which a thermal head and the like contact. The back side layer is formed by coating a composition wherein additives such as a sliding agent, a release agent, a surfactant, inorganic particles, organic particles, and pigments are added to a binder. Further, an interlayer may be disposed between the back side layer and the support. The interlayer and the back side layer preferably contain inorganic fine particles and a water-soluble resin or a hydrophilic resin capable of emulsification.

According to the present invention, it is possible to provide an image-receiving sheet for heat-sensitive transfer recording that is resistant to image defects such as cracking due to the difference in volumetric shrinkage rate, white spots in low density region, image irregularity at high density region, and uneven transfer of the protective layer thereof.

The present invention provides an image-receiving sheet for heat-sensitive transfer recording that is less influenced by modification of the factors such as drying condition for the image-receiving sheet for thermal transfer recording, resistant to cracking due to the difference in volumetric shrinkage rate of the heat-sensitive transfer image-receiving sheet, resistant to image defects such as white spots in low density region and uneven transfer of the protective layer even during high-speed coating.

The present invention will be described in more detail based on the following examples, but the invention is not intended to be limited thereto. In the following Examples, the terms "part" and "%" are values by mass, unless they are indicated differently in particular.

EXAMPLES (Preparation of Heat-Sensitive Transfer Sheet)

A polyester film 6.0 μm in thickness (trade name: Diafoil K200E-6F, manufactured by MITSUBISHI POLYESTER FILM CORPORATION), that was subjected to an easy-adhesion-treatment on one surface of the film, was used as a support. The following back side-layer coating liquid was applied onto the support on the other surface that was not subjected to the easy-adhesion-treatment, so that the coating amount based on the solid content after drying would be 1 g/m$^2$. After drying, the coating liquid was cured by heat at 60° C.

Coating liquids, which will be detailed later, were used to form, onto the easily-adhesive layer coated surface of the thus-formed polyester film, individual heat-sensitive transfer layers in yellow, magenta and cyan, and a transferable protective layer laminate in area order by coating. In this way, a heat-sensitive transfer sheet was prepared. The solid coating amount in each of the heat-sensitive transfer layers (dye layers) was set to 0.8 g/m$^2$.

In the formation of the transferable protective layer laminate, a releasing-layer-coating liquid was coated and the resultant was dried, a protective-layer-coating liquid was coated thereon and the resultant was dried, and then an adhesive-layer-coating liquid was coated thereon.

| <Back side layer-coating liquid> | |
|---|---|
| Acrylic polyol resin (trade name: ACRYDIC A-801, manufactured by Dainippon Ink and Chemicals, Incorporated) | 26.0 mass parts |
| Zinc stearate (trade name: SZ-2000, manufactured by Sakai Chemical Industry Co., Ltd.) | 0.40 mass part |
| Phosphate ester (trade name: PLYSURF A217, manufactured by Dai-ichi Kogyo Seiyaku Co., Ltd.) | 1.30 mass parts |
| Isocyanate (50% solution) (trade name: BURNOCK D-800, manufactured by Dainippon Ink and Chemicals, Incorporated) | 8.0 mass parts |
| Methyl ethyl ketone/Toluene (2/1, at mass ratio) | 64 mass parts |

| <Yellow-dye-layer-coating liquid> | |
|---|---|
| Dye compound (Y-1) | 4.0 mass parts |
| Dye compound (Y-2) | 4.0 mass parts |
| Polyvinylacetal resin (trade name: ESLEC KS-1, manufactured by Sekisui Chemical Co., Ltd.) | 6.1 mass parts |
| Polyvinylbutyral resin (trade name: DENKA BUTYRAL #6000-C, manufactured by DENKI KAGAKU KOGYOU K. K.) | 2.1 mass parts |
| Releasing agent (trade name: X-22-3000T, manufactured by Shin-Etsu Chemical Co., Ltd.) | 0.05 mass part |
| Releasing agent (trade name: TSF4701, manufactured by MOMENTIVE Performance Materials Japan LLC.) | 0.03 mass part |
| Matting agent (trade name: Flo-thene UF, manufactured by Sumitomo Seika Chemicals Co., Ltd.) | 0.12 mass part |
| Methyl ethyl ketone/Toluene (2/1, at mass ratio) | 84 mass parts |

Y-1

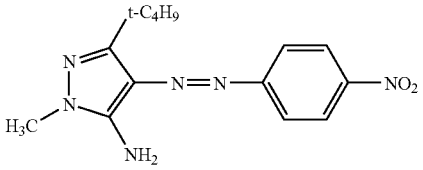

Y-2

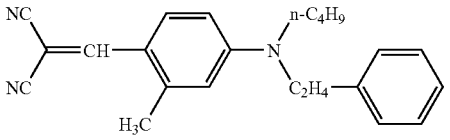

| <Magenta-dye-layer-coating liquid> | |
|---|---|
| Dye compound (M-1) | 0.1 mass part |
| Dye compound (M-2) | 0.8 mass part |
| Dye compound (M-3) | 6.5 mass parts |
| Polyvinylacetal resin (trade name: ESLEC KS-1, manufactured by Sekisui Chemical Co., Ltd.) | 8.0 mass parts |
| Polyvinylbutyral resin (trade name: DENKA BUTYRAL #6000-C, manufactured by DENKI KAGAKU KOGYOU K. K.) | 0.2 mass part |
| Releasing agent (trade name: X-22-3000T, manufactured by Shin-Etsu Chemical Co., Ltd.) | 0.05 mass part |
| Releasing agent (trade name: TSF4701, manufactured by MOMENTIVE Performance Materials Japan LLC.) | 0.03 mass part |
| Matting agent (trade name: Flo-thene UF, manufactured by Sumitomo Seika Chemicals Co., Ltd.) | 0.15 mass part |
| Methyl ethyl ketone/Toluene (2/1, at mass ratio) | 84 mass parts |

-continued

M-1

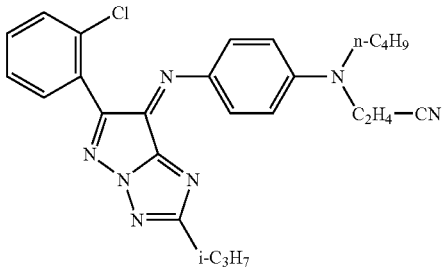

M-2

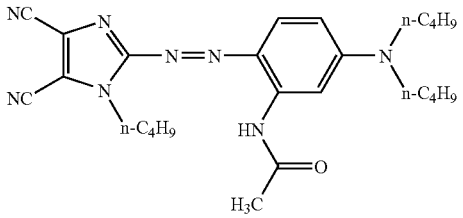

M-3

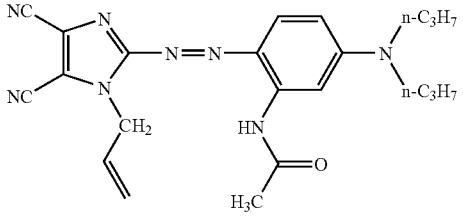

<Cyan-dye-layer-coating liquid>

| | |
|---|---|
| Dye compound (C-1) | 1.4 mass parts |
| Dye compound (C-2) | 6.6 mass parts |
| Polyvinylacetal resin (trade name: ESLEC KS-1, manufactured by Sekisui Chemical Co., Ltd.) | 7.0 mass parts |
| Polyvinylbutyral resin (trade name: DENKA BUTYRAL #6000-C, manufactured by DENKI KAGAKU KOGYOU K. K.) | 0.8 mass part |
| Releasing agent (trade name: X-22-3000T, manufactured by Shin-Etsu Chemical Co., Ltd.) | 0.05 mass part |
| Releasing agent (trade name: TSF4701, manufactured by MOMENTIVE Performance Materials Japan LLC.) | 0.03 mass part |
| Matting agent (trade name: Flo-thene UF, manufactured by Sumitomo Seika Chemicals Co., Ltd.) | 0.15 mass part |
| Methyl ethyl ketone/Toluene (2/1, at mass ratio) | 84 mass parts |

C-1

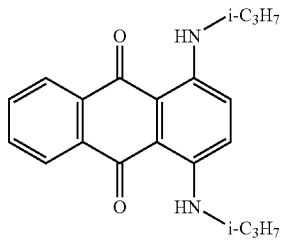

-continued

C-2

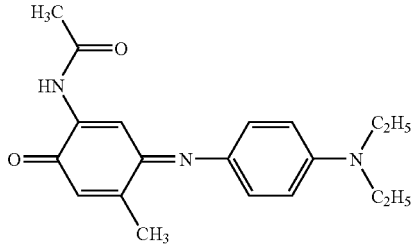

(Transferable Protective Layer Laminate)

On the same polyester film as used in the preparation of the dye layers as described above, coating liquids of a releasing layer, a protective layer and an adhesive layer each having the following composition were coated, to form a transferable protective layer laminate. Coating amounts of the releasing layer, the protective layer and the adhesive layer after drying were set to 0.3 g/m$^2$, 0.5 g/m$^2$ and 2.2 g/m$^2$, respectively.

<Releasing-layer-coating liquid>

| | |
|---|---|
| Modified cellulose resin (trade name: L-30, manufactured by DAICEL CHEMICAL INDUSTRIES, LTD.) | 5.0 mass parts |
| Methyl ethyl ketone | 95.0 mass parts |

<Protective-layer-coating liquid>

| | |
|---|---|
| Acrylic resin (trade name: DIANAL BR-100, manufactured by MITSUBISHI RAYON Co., LTD.) | 32 mass parts |
| Isopropanol | 70 mass parts |

<Adhesive-layer-coating liquid>

| | |
|---|---|
| Acrylic resin (trade name: DIANAL BR-77, manufactured by MITSUBISHI RAYON CO., LTD.) | 25 mass parts |
| The following ultraviolet absorbent UV-1 | 0.8 mass part |
| The following ultraviolet absorbent UV-2 | 2 mass parts |
| The following ultraviolet absorbent UV-3 | 1.5 mass parts |
| The following ultraviolet absorbent UV-4 | 0.7 mass part |
| Silicone resin fine particle (trade name: TOSPEARL 120, manufactured by MOMENTIVE Performance Materials Japan LLC.) | 0.05 mass part |
| Methyl ethyl ketone/Toluene (2/1, at mass ratio) | 70 mass parts |

(UV-1)

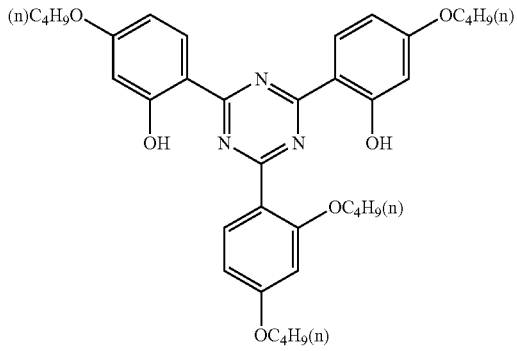

-continued (UV-2)

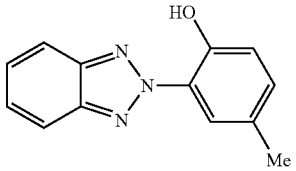

(UV-3)

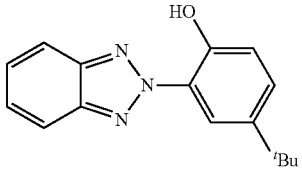

(UV-4)

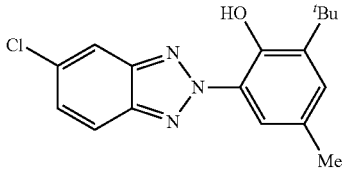

Example 1

(Preparation of Heat-Sensitive Transfer Image-Receiving Sheet 101)

A paper support, on both sides of which polyethylene was laminated, was subjected to corona discharge treatment on the front face thereof, and then a gelatin undercoat layer containing sodium dodecylbenzenesulfonate was disposed on the treated surface. The subbing layer, the heat insulation layer, the receptor layer each having the following composition were simultaneously multilayer-coated on the gelatin undercoat layer, in the state that the subbing layer, the heat insulation layer, the receptor layer were laminated in this order from the side of the support, by a method illustrated in FIG. 9 in U.S. Pat. No. 2,761,791. The coating was performed so that coating amounts of the subbing layer, the heat insulation layer, the receptor layer after drying would be 6.6 g/m$^2$, 8.8 g/m$^2$, 5.0 g/m$^2$, respectively. In addition, the following compositions represent a mass part as a solid content. Further, "%" in proportion of the vinyl chloride monomer represents "mol %".

During drying after coating, dry air previously adjusted to the dry-bulb temperature (D.B.) and the wet-bulb temperature (W.B.) shown in the following Table 1 was blown on the coated surface for drying in a drying zone. Increase in the difference of between the dry-bulb temperature and the wet-bulb temperature [dry-bulb temperature (D.B.)−wet-bulb temperature (W.B.)] leads to increase in the vaporization amount of water from the coated film per unit time. This means that drying in a shortened period of time allows high-speed coating.

An emulsion for preparation of the heat-sensitive transfer image-receiving sheets was prepared in the following manner. Herein, 1,2-benzisothiazolin-3-one was added to each layer in an amount of 500 ppm with respect to the mass of the coating liquid.

(Preparation of Emulsion A)

Emulsion A was prepared in the following manner. Compound A-6 described below was dissolved in a mixture of 42 g of a high-boiling solvent (Solv-1) and 20 ml of ethyl acetate, and the resulting solution was emulsified and dispersed in 250 g of a 20 mass % aqueous gelatin solution containing 1 g of sodium dodecylbenzenesulfonate by means of a high-speed stirring emulsification machine (dissolver). Thereto, water was added to prepare 380 g of Emulsion A.

The addition amount of Compound A-6 was adjusted so that the compound would be contained in an amount of 30 mol % in Emulsion A.

Solv-1

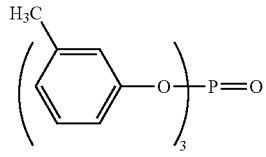

A-6

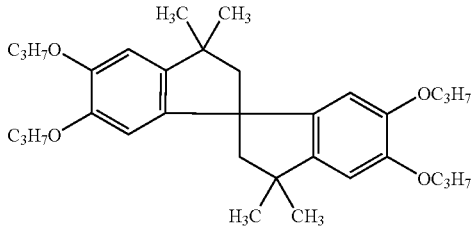

| | |
|---|---|
| <Subbing layer-coating liquid> | |
| Styrene butadiene latex (trade name: SR103, manufactured by NIPPON A & L INC.) | 60 mass parts |
| PVA (6% aqueous solution) (trade name: POVAL PVA 205, manufactured by Kuraray) | 40 mass parts |
| NaOH aqueous ssolution for adjusting pH to 8 | |
| <Heat insulation layer-coating liquid> | |
| Hollow latex polymer (trade name: MH5055, manufactured by Nippon Zeon Co., Ltd.) | 60 mass parts |
| Gelatin (10% aqueous solution) | 20 mass parts |
| NaOH aqueous solution for adjusting pH to 8 | |
| <Receptor layer-coating liquid> | |
| Vinyl chloride-series latex (trade name: VINYBLAN 683, manufactured by Nisshin Chemicals Co., Ltd., Tg: 72° C., vinyl chloride unit rate: 60%) | 49 mass parts |
| Vinyl chloride-series latex (trade name: VINYBLAN 609, manufactured by Nisshin Chemicals Co., Ltd., Tg: 46° C., vinyl chloride unit proportion: 80%) | 21 mass parts |
| Gelatin (10% aqueous solution) | 10 mass parts |
| Microcrystalline wax (trade name: EMUSTAR-042X, manufactured by Nippon Seiro Co., Ltd.) | 5 mass parts |
| Water | 5 mass parts |
| Emulsion A | 10 mass parts |
| NaOH aqueous soluttion for adjusting pH to 8 | |

The composition is the same as that shown in Example 106 of JP-A-2007-229987.

(Preparation of Heat-Sensitive Transfer Image-Receiving Sheet 102)

Heat-sensitive transfer image-receiving sheet 102 was prepared in a manner similar to the heat-sensitive transfer image-receiving sheet 101, except that the two kinds of vinyl chloride-based latexes in the receptor layer-coating liquid were replaced with the following latexes.

| | |
|---|---|
| Vinyl chloride-series latex (trade name: VINYBLAN 900 (Tg 70° C.), manufactured by Nisshin Chemicals Co., Ltd.) | 30 mass parts |
| Polyester-series latex (trade name: VYLONAL MD1100 (Tg 40° C.), manufactured by Toyobo Co., Ltd.) | 40 mass parts |

The composition is the same as that shown in Example 110 of JP-A-2007-229987.

(Preparation of Heat-Sensitive Transfer Image-Receiving Sheet 103)

Heat-sensitive transfer image-receiving sheet 103 was prepared in a manner similar to the heat-sensitive transfer image-receiving sheet 101, except that each of the coating liquids were replaced with the following coating liquids.

| <Subbing layer-coating liquid> | |
|---|---|
| SBR (trade name: SR103, manufactured by Nippon A & L Inc.) | 60 mass parts |
| PVA (6% aqueous solution) (trade name: POVAL PVA 205, manufactured by Kuraray) | 40 mass parts |
| NaOH aqueous solution for adjusting pH to 8 | |
| <Heat insulation layer-coating liquid> | |
| Hollow latex polymer (trade name: MH5055, manufactured by Nippon Zeon Co., Ltd.) | 60 mass parts |
| Gelatin (10% aqueous solution) | 20 mass parts |
| Emulsion A | 20 mass parts |
| NaOH aqueous solution for adjusting pH to 8 | |
| <Receptor layer-coating liquid> | |
| Vinyl chloride-series latex (trade name: VINYBLAN 900, manufactured by Nisshin Chemicals Co., Ltd., Tg: 70° C., vinyl chloride unit proportion: 90%) | 35 mass parts |
| Vinyl chloride-series latex (trade name: VINYBLAN 276, manufactured by Nisshin Chemicals Co., Ltd., Tg: 33° C., vinyl chloride unit proportion: 80%) | 15 mass parts |
| Montan wax (trade name: J537, manufactured by Chukyo Yushi Co., Ltd.) | 35 mass parts |
| Gelatin (10% aqueous solution) | 25 mass parts |
| Sodium salt of 2,4-dichloro-6-hydroxy-1,3,5-triazine | 0.5 mass part |

The composition is the same as that shown in Example 107 of JP-A-2007-237643.

(Preparation of Heat-Sensitive Transfer Image-Receiving Sheet 104)

Heat-sensitive transfer image-receiving sheet 104 was prepared in a manner similar to the heat-sensitive transfer image-receiving sheet 101, except that the amounts of the vinyl chloride-based latexes in the receptor layer-coating liquid were replaced with the following amounts.

| | |
|---|---|
| Vinyl chloride-series latex (trade name: VINYBLAN 683, manufactured by Nisshin Chemicals Co., Ltd., Tg: 72° C., vinyl chloride unit proportion: 90%) | 21 mass parts |

-continued

| | |
|---|---|
| Vinyl chloride-series latex (trade name: VINYBLAN 609, manufactured by Nisshin Chemicals Co., Ltd., Tg: 46° C., vinyl chloride unit proportion: 80%) | 49 mass parts |

A sample having an area of 1 square meter was collected from each heat-sensitive transfer image-receiving sheet thus obtained. The degree of cracking on the coated surface was evaluated by five examiners according to the following criteria.

(Degree of Cracking)

5: No cracking observed in the coated sample and no problem

4: Few microcrackings detectable by visual observation in the coated sample, but without practical problem 3: Microcrackings detectable at several sites by visual observation in the coated sample, causing practical problems in some cases 2: Cracking distinctly detectable at several sites by visual observation in the coated sample, causing practical problems 1: Many cracking distinctly detectable at several sites by visual observation in the coated sample, causing practical problems

TABLE 1

| Heat-sensitive transfer image-receiving sheet No. | D.B. (° C.) | W.B. (° C.) | Evaluation of Cracking by visual observation | Remarks |
|---|---|---|---|---|
| 101 | 17 | 12 | 4 | Comparative example |
| | 20 | 12 | 3 | |
| | 25 | 12 | 2 | |
| | 28 | 12 | 1 | |
| 102 | 17 | 12 | 4 | Comparative example |
| | 20 | 12 | 2 | |
| | 25 | 12 | 1 | |
| 103 | 17 | 12 | 4 | Comparative example |
| | 20 | 12 | 3 | |
| | 25 | 12 | 1 | |
| 104 | 17 | 12 | 5 | This invention |
| | 20 | 12 | 4 | |
| | 25 | 12 | 3 | |
| | 28 | 12 | 3 | |

The results above show that, when the difference between the dry-bulb temperature and the wet-bulb temperature [dry-bulb temperature (D.B.)−wet-bulb temperature (W.B.)] was small, there was no significant difference in the properties among the samples. However, when the difference between the dry-bulb temperature and the wet-bulb temperature [dry-bulb temperature (D.B.)−wet-bulb temperature (W.B-)] was large, i.e., under high-speed coating condition, the samples of the Comparative Examples tended to crack, while the heat-sensitive transfer image-receiving sheets according to the present invention were remarkably improved in the cracking.

Example 2

(Preparation of Heat-Sensitive Transfer Image-Receiving Sheet 201)

The following coating liquids were prepared; a subbing layer, a heat insulation layer and a receptor layer were simultaneously multilayer-coated in this order from the support side in a manner similar to the heat-sensitive transfer image-receiving sheet 101. The coating was performed so that coating amounts of the subbing layer, the heat insulation layer, the receptor layer after drying would be 6.7 g/m$^2$, 8.7 g/m$^2$, 5.0 g/m$^2$, respectively.

To each layer, 1,2-benzisothiazolin-3-one was added in an amount of 500 ppm with respect to the mass of the coating liquid. To the subbing-layer-coating liquid, a sodium salt of 2,4-dichloro-6-hydroxy-s-triazine was added so as to make the coating amount be 3% with respect to the total coated gelatin solid content.

| <Receptor layer-coating liquid> | |
|---|---|
| Vinyl chloride-series latex (trade name: VINYBLAN 900, manufactured by Nisshin Chemicals Co., Ltd., Tg = 70° C., vinyl chloride unit proportion: 90%) | 31.0 mass parts |
| Vinyl chloride-series latex (trade name: VINYBLAN 609, manufactured by Nisshin Chemicals Co., Ltd., (Tg = 46° C.) vinyl chloride unit proportion: 80%) | 56.0 mass parts |
| Gelatin (10% aqueous solution) | 2.0 mass parts |
| The following ester-series wax EW-1 | 8.0 mass parts |
| Fluorine-based oligomer (trade name: Megafac F-472SF, manufactured by Dainippon Ink and Chemicals, Incorporated) | 2.7 mass parts |
| The following Surfactant F-1 | 0.2 mass part |
| The following Surfactant F-2 | 1.0 mass part |
| <Heat insulation layer-coating liquid> | |
| Hollow latex polymer (trade name: MH5055, manufactured by Nippon Zeon Co., Ltd.) | 65.0 mass parts |
| Gelatin (10% aqueous solution) | 35.0 mass parts |
| <Subbing layer-coating liquid> | |
| Styrene butadiene latex (trade name: SR-103, manufactured by NIPPON A & L INC.) | 60 mass parts |
| PVA (6% aqueous solution) (trade name: POVAL PVA 205, manufactured by Kuraray) | 40 mass parts |
| NaOH aqueous solution for adjusting pH to 8 | |

(EW-1)

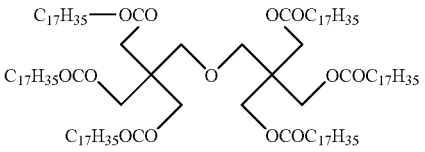

(F-1)

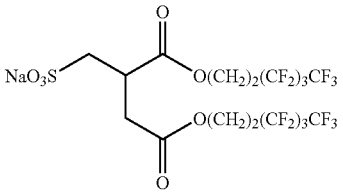

(F-2)

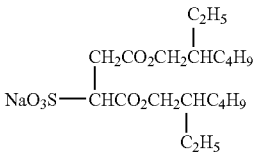

(Preparation of Heat-Sensitive Transfer Image-Receiving Sheet 202)

Heat-sensitive transfer image-receiving sheet 202 was prepared in a manner similar to the heat-sensitive transfer image-receiving sheet 201, except that the two kinds of the vinyl chloride-based latexes in preparation of the heat-sensitive transfer image-receiving sheet 201 were replaced with the following two kinds of latexes.

| | |
|---|---|
| Vinyl chloride-series latex (trade name: VINYBLAN 900, manufactured by Nisshin Chemicals Co., Ltd., Tg = 70° C., vinyl chloride unit proportion: 90%) | 60.0 mass parts |
| Vinyl chloride-series latex (trade name: VINYBLAN 609, manufactured by Nisshin Chemicals Co., Ltd., Tg = 46° C., vinyl chloride unit proportion: 80%) | 25.0 mass parts |

(Preparation of Heat-Sensitive Transfer Image-Receiving Sheet 203)

Heat-sensitive transfer image-receiving sheet 203 was prepared in a manner similar to the heat-sensitive transfer image-receiving sheet 201, except that the following vinyl chloride-based latexes were used instead of the vinyl chloride-based latexes in the receptor layer-coating liquid.

| | |
|---|---|
| Vinyl chloride-series latex (trade name: VINYBLAN 900, manufactured by Nisshin Chemicals Co., Ltd., Tg = 70° C., vinyl chloride unit proportion: 90%) | 31.0 mass parts |
| Vinyl chloride-series latex (trade name: VINYBLAN 276, manufactured by Nisshin Chemicals Co., Ltd., Tg = 33° C., vinyl chloride unit proportion: 80%) | 56.0 mass parts |

(Preparation of Heat-Sensitive Transfer Image-Receiving Sheet 204)

Heat-sensitive transfer image-receiving sheet 204 was prepared in a manner similar to the heat-sensitive transfer image-receiving sheet 201, except that the two kinds of the vinyl chloride-based latexes in preparation of the heat-sensitive transfer image-receiving sheet 201 were replaced with the following two kinds of latexes.

| | |
|---|---|
| Polyester-series latex (trade name: VYLONAL MD1200 (Tg 67° C.), manufactured by Toyobo Co., Ltd.) | 15.0 mass parts |
| Vinyl chloride-series latex (trade name: VINYBLAN 609, manufactured by Nisshin Chemicals Co., Ltd., Tg = 46° C., vinyl chloride unit proportion: 80%) | 70.0 mass parts |

(Preparation of Heat-Sensitive Transfer Image-Receiving Sheet 205)

Heat-sensitive transfer image-receiving sheet 205 was prepared in a manner similar to the heat-sensitive transfer image-receiving sheet 201, except that the receptor layer-coating solution used in preparation of the heat-sensitive transfer image-receiving sheet 201 was replaced with the following receptor layer-coating solution.

| Receptor layer-coating liquid | |
|---|---|
| Vinyl chloride-series latex (trade name: VINYBLAN 900, manufactured by Nisshin Chemicals Co., Ltd., Tg = 70° C., vinyl chloride unit proportion: 90%) | 31.0 mass parts |
| Vinyl chloride-series latex (trade name: VINYBLAN 609, manufactured by Nisshin Chemicals Co., Ltd., Tg = 46° C., vinyl chloride unit proportion: 80%) | 56.0 mass parts |

-continued

| Receptor layer-coating liquid | |
|---|---|
| Gelatin (10% aqueous solution) | 2.0 mass parts |
| The following ester-series wax EW-1 | 8.0 mass parts |
| Fluorine-based oligomer (Megafac F-472SF, manufactured by Dainippon Ink and Chemicals, Incorporated) | 1.3 mass parts |
| Fluorine-based oligomer (Megafac F-483, manufactured by Dainippon Ink and Chemicals, Incorporated) | 1.4 mass parts |
| Surfactant F-1 | 0.2 mass part |
| Surfactant F-2 | 1.0 mass part |

Each heat-sensitive transfer image-receiving sheet above was evaluated similarly to Example 1, and the results obtained are summarized in the following Table 2.

TABLE 2

| Heat-sensitive transfer image-receiving sheet No. | D.B. (° C.) | W.B. (° C.) | Evaluation of cracking by visual observation | Remarks |
|---|---|---|---|---|
| 201 | 17 | 12 | 5 | This invention |
| | 20 | 12 | 5 | |
| | 25 | 12 | 4 | |
| 202 | 17 | 12 | 4 | Comparative example |
| | 20 | 12 | 2 | |
| | 25 | 12 | 2 | |
| 203 | 17 | 12 | 5 | This invention |
| | 20 | 12 | 5 | |
| | 25 | 12 | 4 | |
| 204 | 17 | 12 | 5 | This invention |
| | 20 | 12 | 4 | |
| | 25 | 12 | 4 | |
| 205 | 17 | 12 | 5 | This invention |
| | 20 | 12 | 5 | |
| | 25 | 12 | 5 | |
| | 28 | 12 | 5 | |

The results above show that it was possible to obtain the advantageous effects of the present invention by adding the fluorine-based oligomer to the receptor layer. Comparing the above samples with the sample No. 104 in Example 1, when the fluorine-based oligomer was added to the receptor layer, it was possible to obtain further advantageous effects of the present invention and to carry out a high-speed coating.

Example 3

(Preparation of Latex Polymers 1 to 5)

A polymerization container equipped with a stirrer, a condenser, a thermometer and a nitrogen gas inlet was flushed with nitrogen thoroughly; 1150 g of deionized water, 100 g of ethyl acrylate and 30 g of sodium dodecylbenzenesulfonate were added thereto; and 900 g of vinyl chloride was added additionally while the polymerization container was kept under reduced pressure. The polymerization container was heated to 60° C.; 50 g of 1% aqueous ammonium persulfate solution was injected under pressure to initiate reaction; and the mixture was allowed to react at an inner temperature kept at 60° C. for 16 hours until completion of polymerization. The mixture was then cooled to 30° C. and was adjusted to pH 7 to 8 by addition of 25% aqueous ammonia, to prepare latex polymer 1. After the preparation of the latex polymer 1, the emulsion (latex polymer) was coated on a dry glass plate, and only polymer component therein was extracted with chloroform. The obtained extract was analyzed by H-NMR, to show that the emulsion 1 thus prepared had a composition of (vinyl chloride):(ethyl acrylate) at 90:10.

Separately, latex polymers 2 to 5 each having polymer composition shown in the following Table 3 were prepared in a manner similar to the latex polymer 1, except that the use amount of vinyl chloride was changed.

TABLE 3

| Latex polymer | Polymer composition: Vinyl chloride unit (mol %) | Polymer composition: Ethyl acrylate unit (mol %) | Glass transition temperature Tg (° C.) |
|---|---|---|---|
| 1 | 90 | 10 | 70 |
| 2 | 92 | 8 | 72 |
| 3 | 94 | 6 | 74 |
| 4 | 96 | 4 | 76 |
| 5 | 98 | 2 | 78 |

(Preparation of Heat-Sensitive Transfer Image-Receiving Sheets 301 to 305)

Heat-sensitive transfer image-receiving sheets 301 to 305 were prepared in a manner similar to the heat-sensitive transfer image-receiving sheet 205, except that VINYBLAN 900 used in the receptor layer-coating liquid for the heat-sensitive transfer image-receiving sheet 205 was replaced with the latex polymers 1 to 5 shown in Table 3.

Each heat-sensitive transfer image-receiving sheet above was evaluated similarly to Example 1, and the results obtained are summarized in the following Table 4.

TABLE 4

| Heat-sensitive transfer image-receiving sheet No. | D.B. (° C.) | W.B. (° C.) | Evaluation of cracking by visual observation | Remarks |
|---|---|---|---|---|
| 301 | 28 | 12 | 5 | This invention |
| | 30 | 12 | 4 | |
| | 32 | 12 | 4 | |
| 302 | 28 | 12 | 5 | This invention |
| | 30 | 12 | 5 | |
| | 32 | 12 | 4 | |
| 303 | 28 | 12 | 5 | This invention |
| | 30 | 12 | 5 | |
| | 32 | 12 | 4 | |
| 304 | 28 | 12 | 5 | This invention |
| | 30 | 12 | 5 | |
| | 32 | 12 | 5 | |
| 305 | 28 | 12 | 5 | This invention |
| | 30 | 12 | 5 | |
| | 32 | 12 | 5 | |
| | 34 | 12 | 5 | |

The Table 4 shows that it was possible to obtain the advantageous effects of the present invention more favorably under high D.B. conditions, when the content of the recurring unit obtained from the vinyl chloride monomer in the latex polymer having a glass transition temperature (Tg) of 50° C. or higher was 92 mol % or more.

Example 4

(Image Formation)

As a printer for forming an image, Fujifilm thermal photo printer ASK-2000L (trade name, manufactured by FUJIFILM Corporation) was used. The above-described heat-sensitive transfer sheet and each of the above-described heat-sensitive transfer image-receiving sheets produced were prepared for loading it in the printer. Using these sheets, continuous gradation image changing from white to max gray (solid black) was output.

On evaluating white spots in low density region, image irregularity at high density region and uneven transfer of the protective layer, the heat-sensitive transfer image-receiving sheet Nos. 201 and 203 to 205 were superior to the heat-sensitive transfer image-receiving sheet No. 104. In addition, the heat-sensitive transfer image-receiving sheet Nos. 302 to 305 containing latex polymer having a glass transition temperature (Tg) of 50° or more and a recurring unit obtained from vinyl chloride monomer in an amount of 92 mol % or more were quite excellent.

As is clear from above, the present invention can provide a high-quality heat-sensitive transfer image-receiving sheet without causing crack even under high-speed coating condition, whitening in low density region, irregularity in image density at high density region, and uneven transfer of the protective layer.

Having described our invention as related to the present embodiments, it is our intention that the present invention not be limited by any of the details of the description, unless otherwise specified, but rather be construed broadly within its spirit and scope as set out in the accompanying claims.

This non-provisional application claims priority under 35 U.S.C. §119 (a) on Patent Application No. 2008-019858 filed in Japan on Jan. 30, 2008, which is entirely herein incorporated by reference.

What is claimed is:

1. A heat-sensitive transfer image-receiving sheet, comprising a support, and at least one heat insulation layer containing hollow polymer particles and at least one receptor layer provided on the support in this order, wherein the receptor layer comprises a latex polymer having a glass transition temperature (Tg) of lower than 50° C. and a latex polymer having a glass transition temperature (Tg) of 50° C. or higher, wherein the latex polymer having a glass transition temperature (Tg) of lower than 50° C. is contained in an amount, as solid content, larger than an amount of the latex polymer having a glass transition temperature (Tg) of 50° C. or higher, and wherein the latex polymer having a glass transition temperature (Tg) of lower than 50° C. is a latex polymer having a recurring unit obtained from vinyl chloride monomer in the amount of 50 mol % or more.

2. The heat-sensitive transfer image-receiving sheet according to claim 1, wherein the receptor layer further comprises at least one kind of polymer compound having fluorine atom-substituted aliphatic groups on its side chains.

3. The heat-sensitive transfer image-receiving sheet according to claim 1, wherein the latex polymer having a glass transition temperature (Tg) of 50° C. or higher is a latex polymer having a recurring unit obtained from vinyl chloride monomer in the amount of 92 mol % or more.

4. The heat-sensitive transfer image-receiving sheet according to claim 2, wherein the latex polymer having a glass transition temperature (Tg) of 50° C. or higher is a latex polymer having a recurring unit obtained from vinyl chloride monomer in the amount of 92 mol % or more.

* * * * *